US009617769B2

(12) United States Patent
Polo Friz

(10) Patent No.: US 9,617,769 B2
(45) Date of Patent: Apr. 11, 2017

(54) THREE-DIMENSIONAL ADJUSTABLE HARDWARE SYSTEM

(71) Applicant: SFS intec Holding Ag, Heerbrugg (CH)

(72) Inventor: Fabio Polo Friz, Giais di Aviano (IT)

(73) Assignee: SFS intec Holding AG, Heerbrugg (CH)

( * ) Notice: Subject to any disclaimer, the term of this patent is extended or adjusted under 35 U.S.C. 154(b) by 0 days.

(21) Appl. No.: 14/889,650

(22) PCT Filed: Mar. 13, 2014

(86) PCT No.: PCT/EP2014/054937
§ 371 (c)(1),
(2) Date: Nov. 6, 2015

(87) PCT Pub. No.: WO2014/183903
PCT Pub. Date: Nov. 20, 2014

(65) Prior Publication Data

US 2016/0123056 A1 May 5, 2016

(30) Foreign Application Priority Data

May 16, 2013 (DE) ..... 10 2013 008 548

(51) Int. Cl.
*E05D 7/04* (2006.01)
*E05D 3/18* (2006.01)
*E05D 3/06* (2006.01)

(52) U.S. Cl.
CPC ..... *E05D 7/04* (2013.01); *E05D 3/18* (2013.01); *E05D 3/186* (2013.01); *E05D 7/0423* (2013.01);
(Continued)

(58) Field of Classification Search
CPC E05D 3/18; E05D 7/04; E05D 7/0407; E05D 7/0423; E05D 2007/0492
(Continued)

(56) References Cited

U.S. PATENT DOCUMENTS 6,829,808 B2 * 12/2004 Neukotter ..... E05D 3/186 16/366
7,516,516 B2 * 4/2009 Wu ..... E05D 7/0415 16/238
(Continued)

FOREIGN PATENT DOCUMENTS

| | | |
|---|---|---|
| DE | 102008057341 | 12/2009 |
| DE | 202010010645 | 11/2010 |
| EP | 1063376 | 12/2000 |

*Primary Examiner* — Roberta Delisle
(74) *Attorney, Agent, or Firm* — Volpe and Koenig, P.C.

(57) ABSTRACT

The invention relates to a three-dimensional adjustable hardware system. According to the invention, at least one of the hardware bodies (18) comprises at least one guide pin (28) for the purpose of adjusting the hardware system (10) in the z-direction and the housing, in which the at least hardware body is arranged, comprises at least one threaded pin (30, 32), wherein the guide pin (28) and thereby the hardware body (18) are moved relative to the housing in the z-direction when the threaded pin (30) is rotated. For the purpose of adjusting the hardware system in the x-direction at least one of the hardware bodies (16) accommodates at least one adjusting pin (34), which can be moved along the y-axis located in the xy-plane, and at least one surface (36, 38) of the adjusting pin (34) which is inclined with respect to the y-axis interacts with at least one sliding pin (40, 42), the movement of which along the x-axis located in the xy-plane being restricted by the housing (12) accommodating the at least one hardware body (16), and so the hardware body (16) can be moved relative to the housing (12) in the x-direction by adjusting the adjustment pin (34). For the
(Continued)

purpose of adjusting the hardware system in the y-direction at least one housing (14) and the hardware body (18) arranged in said housing have at least one sliding guide (44) extending along the y-axis, along which the hardware body can be moved relative to the housing (14) in the y-direction.

14 Claims, 5 Drawing Sheets

(52) U.S. Cl.
CPC ..... *E05D 3/06* (2013.01); *E05D 2007/0484* (2013.01); *E05D 2007/0492* (2013.01); *E05Y 2201/638* (2013.01); *E05Y 2600/634* (2013.01)

(58) Field of Classification Search
USPC .. 16/235, 236, 237–238, 245, 241, 248, 385
See application file for complete search history.

(56) References Cited

U.S. PATENT DOCUMENTS

| | | | | |
|---|---|---|---|---|
| 7,614,116 | B2 * | 11/2009 | Chen | E05D 7/04 16/238 |
| 7,698,782 | B2 * | 4/2010 | Lautenschlager | E05D 5/065 16/235 |
| 7,861,378 | B2 * | 1/2011 | Neukotter | E05D 3/06 16/237 |
| 8,196,265 | B2 * | 6/2012 | Neukoetter | E05D 3/186 16/236 |
| 2010/0122431 | A1 | 5/2010 | Neukoetter et al. | |
| 2011/0296652 | A1 * | 12/2011 | Zhang | E05D 7/0027 16/239 |
| 2012/0291225 | A1 * | 11/2012 | Liermann | E05D 3/186 16/364 |

* cited by examiner

THREE-DIMENSIONAL ADJUSTABLE HARDWARE SYSTEM

BACKGROUND

The invention relates to a three-dimensionally adjustable hardware system comprising a first housing and a second housing, a first hardware body which is arranged in the first housing at least in part, and a second hardware body which is arranged in the second housing at least in part, and a lever system which interconnects the first hardware body and the second hardware body, wherein the extension of at least one lever of the lever system defines an xy-plane between the first hardware body and the second hardware body and defines a z-axis perpendicularly to the xy-plane, and wherein, in order to adjust the hardware system in the y-direction, at least one housing and the hardware body arranged therein comprise at least one sliding guide which extends along the y-axis and along which the hardware body can be displaced relative to the housing in the y-direction.

Hardware systems of this type are used for interconnecting two bodies, said bodies being able to pivot relative to one another by means of the hardware system. For this purpose, the first housing is for example inserted into an appropriate hollow in a door frame or window frame, while the second housing is placed in a corresponding hollow in the pivotable part of the door or window. Together with the hardware bodies arranged therein, the housings are rigidly attached to the components thus connected. By means of a lever system which extends between the hardware bodies, the components which are now equipped with the hardware system can be pivoted relative to one another. For reasons of simplicity, in the following reference is made only to doors as an example of any pivoting system.

The hardware systems being described herein are in particular designed so as to be virtually completely invisible when the door is closed, since they are set into the opposing end faces of the door and the door frame. When the door is opened, it has to be ensured that the lever system extending between the hardware bodies creates sufficient spacing between the hardware bodies so that the door or window can preferably be pivoted open by 180°.

Hardware systems of this type are distinguished by high stability, and so said systems are particularly suitable for use in conjunction with extremely large and heavy doors. It is immediately obvious that, as a result, not only are high demands placed in terms of stability, but also in terms of the adjustability or readjustability of the systems.

EP 1 063 376 B2 discloses a hardware system which is designed to allow for adjustability in the x, y and z-direction when mounted.

DE 20 2010 010 645 U1 discloses a generic hardware system which comprises a hinge which can be mortised completely and has adjustment devices in three axes.

SUMMARY

The object of the invention is to provide a three-dimensionally adjustable hardware system which is sturdy, durable, convenient for daily use, reliable, and easy to adjust.

This object is achieved by the features of the independent claim.

Advantageous embodiments of the invention are set out in the dependent claims.

The invention builds on the generic three-dimensionally adjustable hardware system in that, in order to adjust the hardware system in the z-direction, at least one of the hardware bodies comprises at least one guide pin and the housing in which the at least one hardware body is arranged comprises at least one threaded pin, wherein, the guide pin and thus the hardware body is displaced relative to the housing in the z-direction by rotating the threaded pin, and in that, in order to adjust the hardware system in the x-direction, at least one of the hardware bodies receives at least one adjustment pin which can be displaced along the y-axis located in the xy-plane, and at least one face of the adjustment pin, which face is oblique with respect to the y-axis, interacts with at least one sliding pin, the movement of which along the x-axis, located in the xy-plane, is limited by the housing which receives the at least one hardware body, such that the hardware body can be displaced relative to the housing (12) in the x-direction by displacing the adjustment pin.

On the basis of these features, a reliable three-dimensionally adjustable hardware system can be provided. The adjustment in the z-direction uses one or more threaded pins so that simple and durable adjustment is ensured, in particular in terms of the gravity acting in the z-direction. Adjustment in the x-direction can also be carried out in a precise manner. There is no need to release any connections between the housing and the hardware body, in order to carry out the adjustment, and to then re-establish the connections afterwards. Instead, movement of the hardware body relative to the housing in the x-direction can be achieved by merely displacing an adjustment pin. In the y-direction, a sliding guide ensures precise displacement between the housing and the hardware body, which displacement can take place regardless of the displacement in the other directions.

The present invention will be explained with the aid of a Cartesian coordinate system. The aforementioned directions (x, y and z) are defined as follows using the example of a door. The z-direction extends vertically and the x-direction extends perpendicularly to the face of the closed door and thus inevitably horizontally. The y-direction extends perpendicularly to both the z-direction and the x-direction and thus in parallel with the face of the closed door, and likewise horizontally. Although the invention is thus explained for the most frequently used normal case by far, i.e. on the basis of windows and doors which close vertically extending openings in walls, the invention is not limited thereto. It goes without saying that there can always be minor differences from the aforementioned normal case. In addition, as is widely known, the hardware system can also be designed in such a way that a housing of the hardware system does not extend vertically when installed, but rather obliquely to the vertical. This allows an open door to close by itself, or for an unlocked door to open by itself. It should also be pointed out that the hardware systems are not only suitable for connecting components, one of which is fixed, as is the case with doors and windows in the construction field. Movable units such as crates or chests or the like can also be equipped with the hardware system according to the invention.

The invention is advantageously developed in that, in order to adjust the hardware system in the z-direction, the at least one hardware body comprises two guide pins which are arranged on opposite ends of the hardware body in the z-direction, in that the guide pins comprise faces that are oblique with respect to the z-axis, in that a threaded pin is associated with each guide pin, and in that the ends of the threaded pins interact in each case with the oblique faces of the guide pins. By means of the oblique face of the guide pin, a movement of the threaded pin in the y-direction can be converted into a movement of the hardware body in the z-direction relative to the housing. This is advantageous since the threaded pin is thus easily accessible when the door is open.

It is advantageously provided for at least one threaded pin to have a conical end which interacts with the oblique face of the associated guide pin. The result is an effective and precise interaction of the threaded pin and the guide pin.

In this context, it can also be provided for the oblique faces of the guide pins to be formed as flat faces or conical surfaces.

According to a preferred embodiment of the invention, it is provided for at least one threaded pin to extend perpendicularly to the z-axis. In the simplest case, the threaded pin extends in the y-direction, since easy access is thus possible using a screwdriver or a hex key. However, it is also conceivable for the threaded pin to extend in the x-direction, yet perpendicularly to the z-axis, although the threaded pin then has to be accessed in a different direction from the direction of the axis of the threaded pin. For this purpose, relatively complex designs are routinely needed.

It should also be mentioned in this connection that it can be provided for at least one threaded pin to extend in parallel with the z-axis.

The hardware system according to the invention is particularly advantageously developed in that, in order to adjust the hardware system in the x-direction, the adjustment pin extending in the y-direction engages in a hole in the hardware body and is provided with a recess which comprises conical surfaces at its opposite ends in the y-direction, which faces each interact with the sliding ends of two sliding pins, the opposite ends of the sliding pins forming a stop with the housing and being slidingly connected to the hardware body such that the hardware body can be displaced relative to the housing by displacing the adjustment pin in the x-direction. The interaction of the conical regions, which delimit the recess, with the sliding pins allows for precise displacement in the x-direction. The sliding pins provide a stop with respect to the housing so as to thereby allow for the relative displacement of the hardware body and housing.

According to another embodiment, the hardware system according to the invention is developed such that, in order to adjust the hardware system in the x-direction, the adjustment pin extending in the y-direction engages in a hole in the hardware body and comprises a conical end which interacts with the sliding end of a sliding pin, the opposite end of the sliding pin forming a stop with a first housing side and being slidingly connected to the hardware body, and a spring being supported on a second housing side, which is opposite the first housing side, and on the hardware body. According to this embodiment, the hardware body and the housing are only actively relatively displaced by the adjustment pin in one direction, whereas in the event of displacement in the other direction, the adjustment pin allows a spring to bring about the relative displacement.

It is advantageously provided for contacts between the adjustment pin and the sliding pins to be formed by contact lines. This makes it possible to carry out a precise and effective adjustment.

According to a preferred embodiment, it is provided for both the hole in the hardware body and the adjustment pin to be provided with a corresponding thread. In principle, an adjustment pin which is displaced in the y-direction in order to adjust the hardware system in the x-direction can also be produced without a thread if the required friction or locking between the adjustment pin and the adjustment pin guide is in fact provided in another manner. However, it is particularly advantageous to equip the adjustment pin and the hardware body with threads, since this makes it possible to carry out very precise and convenient adjustments.

The invention is advantageously developed in that, in order to adjust the hardware system in the y-direction, at least one threaded screw is provided, which is mounted in a hardware body and is guided by a threaded element, the movement of which in the y-direction is limited by the associated housing. The displacement in the y-direction is thus also carried out in a particularly precise manner owing to the action of the thread.

It is particularly advantageous for the threaded element to carry the guide pin provided for adjusting the hardware system in the z-direction. In this way, one single component, i.e. the threaded element, fulfils functions in terms of both the adjustment in the z-direction and the adjustment in the y-direction.

The hardware system according to the invention is particularly advantageously developed in that the lever system comprises sliding faces which interact with sliding guides of the hardware bodies, sliding rotation points which are fixed to the hardware body, and a hinge pin which can be moved along the xy-plane, the sliding faces and/or the sliding guides and/or the sliding rotation points and/or components of the hinge pin being equipped with plastics material, in particular Teflon. This ensures that the hardware system is used with low wear. Furthermore, plastics guides prevent squeaking or other noises in the region of the hinge even after many years of use. As a result, the hinge or the door or window in which the hardware system is installed is perceived as being particularly high-quality.

A further preferred embodiment of the hardware system according to the invention consists in a plurality of levers of the lever system being attached in each case to one hardware body by means of a hinge pin and in each case interacting with the other hardware body by means of a sliding guide. By mounting the levers to be fixed on one side and free on the other, it is possible for the lengths of the levers to automatically vary with respect to one another while the interconnected components are pivoting. This allows the interconnected components to be opened by 180° or even by more than 180°.

BRIEF DESCRIPTION OF THE DRAWINGS

The invention will now be explained by way of example with reference to the accompanying drawings on the basis of particularly preferred embodiments, in which drawings.

DETAILED DESCRIPTION OF THE PREFERRED EMBODIMENTS

The embodiments of the invention are explained using the example of a door. It goes without saying that the embodiments can readily be transferred to windows and the like and to other components which are to be provided with the ability to pivot with respect to one another.

Figure 1:
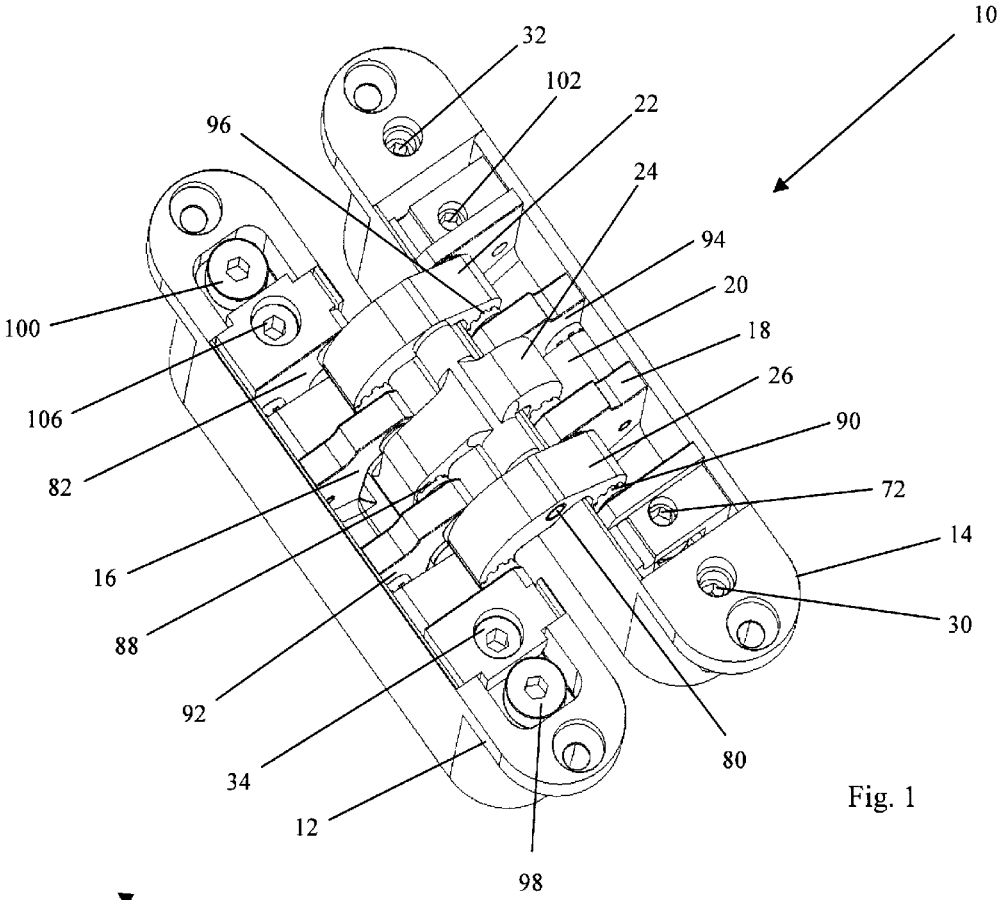
FIG. 1 is a perspective view of a hardware system according to the invention.

FIG. 1 is a perspective view of a hardware system 10 according to the invention. The position of the hardware system 10 corresponds to an open door (cf. FIG. 10). The hardware system 10 comprises a first housing 12 having a first hardware body 16 arranged therein, and a second housing 14 having a second hardware body 18 arranged therein. The hardware bodies 16, 18 are interconnected by means of a lever system 20 which comprises a plurality of levers 22, 24, 26. Each lever 22, 24, 26 of the lever mechanism 20 is mounted on one side in a hinge pin fixed to the hardware body, while said lever is guided in the other hardware body 16, 18, i.e. on the other side of the lever 22, 24, 26, in a sliding guide provided by the hardware body 16, 18. For example, the lever 26 shown at the bottom on the right-hand side is mounted in the hinge pin 90 provided by the hardware body 18. On the other side, said lever is guided in the hardware body 16 by the sliding guide 92, which body consists of two opposing sliding faces, only one of the sliding faces being visible. The situation is similar for the lever 22 shown at the top on the left-hand side which rests on the hinge pin 96 of the hardware body 18 and is guided in the sliding guide 82 of the hardware body 16, which guide likewise consists of two opposing sliding faces. This is different in the case of the middle lever 24, which is fixedly mounted in a hinge pin 88 of the other hardware body 16. A sliding guide 94 is provided by the hardware body 18, again by means of two opposing faces. The levers 22, 24, 26 are interconnected between the hardware bodies 16, 18 by means of a common hinge pin 80. The first hardware body 16 is attached to the housing 12 by means of fastening screws 98, 100. In the case of the second hardware body 18, the fastening to the housing 14 is performed by threaded screws 72, 102, which perform an additional function in the adjustment of the hardware system 10 in the y-direction. This is explained in more detail below in connection with FIGS. 2 to 4. In addition, threaded pins 30, 32 are provided and adjust the hardware system 10 in the z-direction. This is also explained in more detail in connection with FIGS. 2 to 4. Adjustment pins 34, 106 which allow the hardware system 10 to be adjusted in the x-direction are provided on the first hardware body 16. Reference is made in this regard to the explanations relating to FIGS. 5 and 6.

Figure 2:
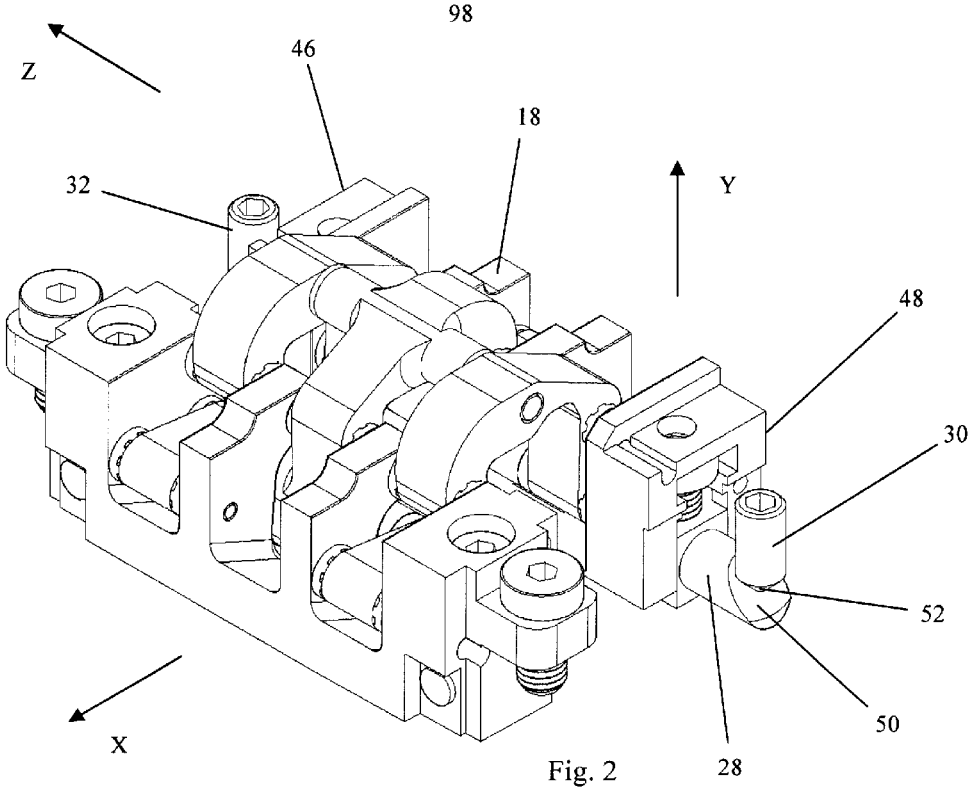
FIG. 2 is a perspective view of two hardware bodies comprising a lever system.
Figure 3:
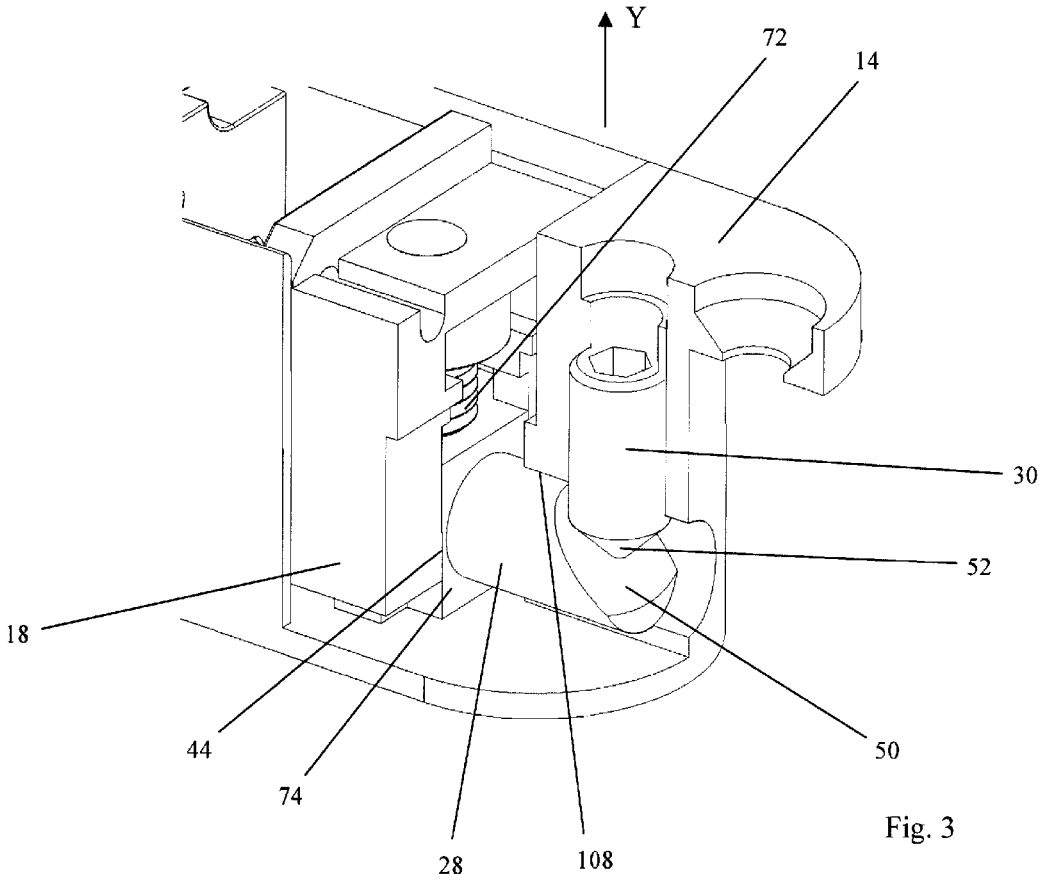
FIG. 3 is a partial sectional view of a detail of a hardware system according to the invention.
Figure 4:
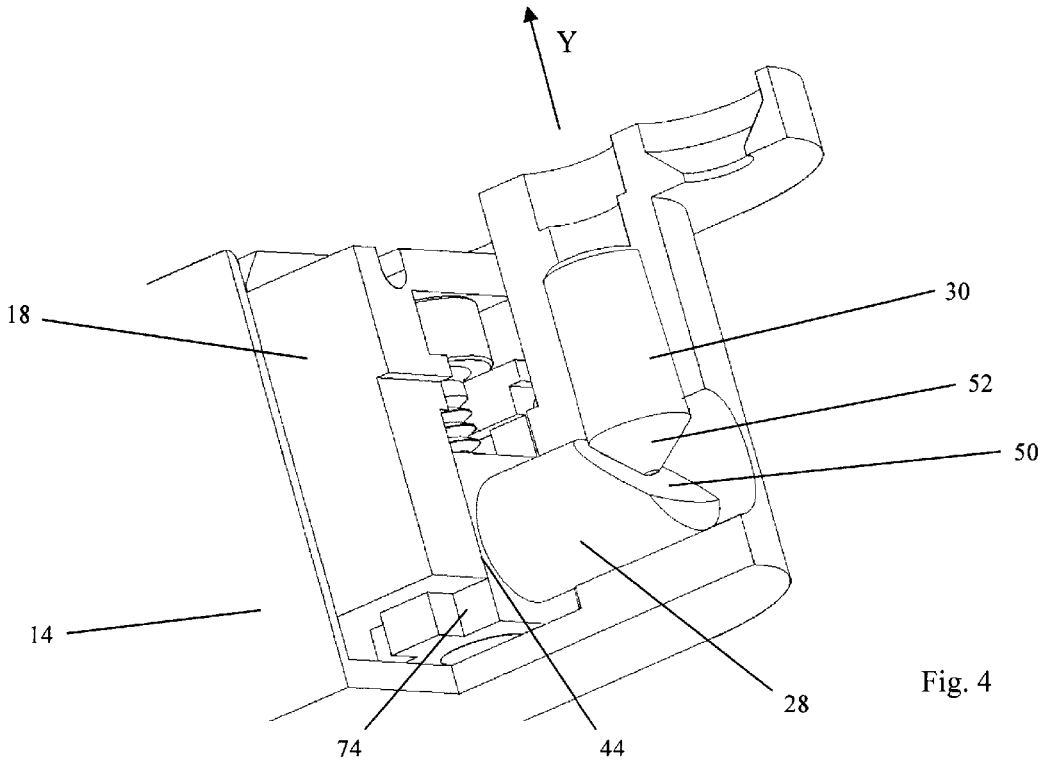
FIG. 4 is a further partial sectional view of a detail of a hardware system according to the invention.

The adjustment of the hardware system 10 in the z-direction is explained in more detail with particular reference to FIGS. 2 to 4. Unlike in FIG. 1, the housings 12, 14 have been removed in FIG. 2. Only the threaded pins 30, 32 which are positioned so as to be fixed to the housing when installed are shown. Additional housing parts can be seen in the detail views according to FIGS. 3 and 4. A guide pin 28, the end of which is an oblique face 50, is arranged at one end 48 of the second hardware body 18. This guide pin 28 is carried by a threaded element 74 which cannot be displaced relative to the hardware body 18 in particular in the z-direction. This is ensured by a threaded screw 72 fastening the threaded element 74 to the second hardware body 18. A similar situation can be seen at the other end 46 of the hardware body 18, where, in the view according to FIG. 2, only the threaded pin 32 can be seen. The associated guide pin is formed so as to be symmetrical to the guide pin 28 in relation to the xy-plane. A threaded element (which cannot be seen here) is also provided for carrying the guide pin (not visible) and for fastening said pin to the hardware body 18. If the hardware body 18 is now displaced relative to the housing 14 in the z-direction, it must be ensured that the threaded pin 32 does not come into contact with the oblique face of the associated guide pin. If this is the case, the threaded pin 32 should be released. Then, the threaded pin 30, which is generally in contact with the oblique face 50 of the guide pin 28 when the hardware system 10 is in use, has to be adjusted such that it travels downwards, i.e. in the negative y-direction. As a result, the second hardware body 18 moves relative to the housing 14 in the z-direction by the conical end 52 of the threaded pin 32 sliding on the oblique face 50. To displace the second hardware body 18 in the negative z-direction, the threaded pin 30 has to be rotated such as to move in the y-direction. As a result, the second hardware body 18 can move downwards relative to the housing 14, provided that the hardware system 10 is mounted vertically in a door. If this is not the case, the displacement in the negative z-direction can be brought about or assisted by screwing in the threaded pin 32.

The adjustment of the hardware system 10 in the y-direction is also described with particular reference to FIGS. 2 and 4, the explanations being limited to those relating to the bottom end 48 of the hardware body 18. An identical mechanism is found at the other end 46 of the hardware body 18. As can be seen in FIGS. 3 and 4, the guide pin 28 is carried by the threaded element 74. The guide pin 28 projects from the threaded element 74 through an opening 108 in the housing 14 so that the oblique face 50 of the guide pin 28 is arranged below the threaded pin 30. Owing to the guide pin 28 being guided with an exact fit through the housing opening 108, it is also ensured that the threaded element 74 cannot be displaced in the y-direction. If the threaded screw 72, which is mounted in the hardware body 18 so as to be non-displaceable in the y-direction, is thus rotated, the hardware body 18 is displaced relative to the housing 14, by means of the sliding guide 44 between the hardware body 18 and the threaded element 74. The hardware system 10 is therefore adjusted in the y-direction merely by rotating the threaded screw 72 in different directions. Particular mention should be made of the fact that the threaded screw 72, and of course the counterpart thereof on the other end of the hardware body 18, is also used to attach the hardware body 18 to the housing 14. No additional fastening element is necessary for this purpose.

Figure 5:
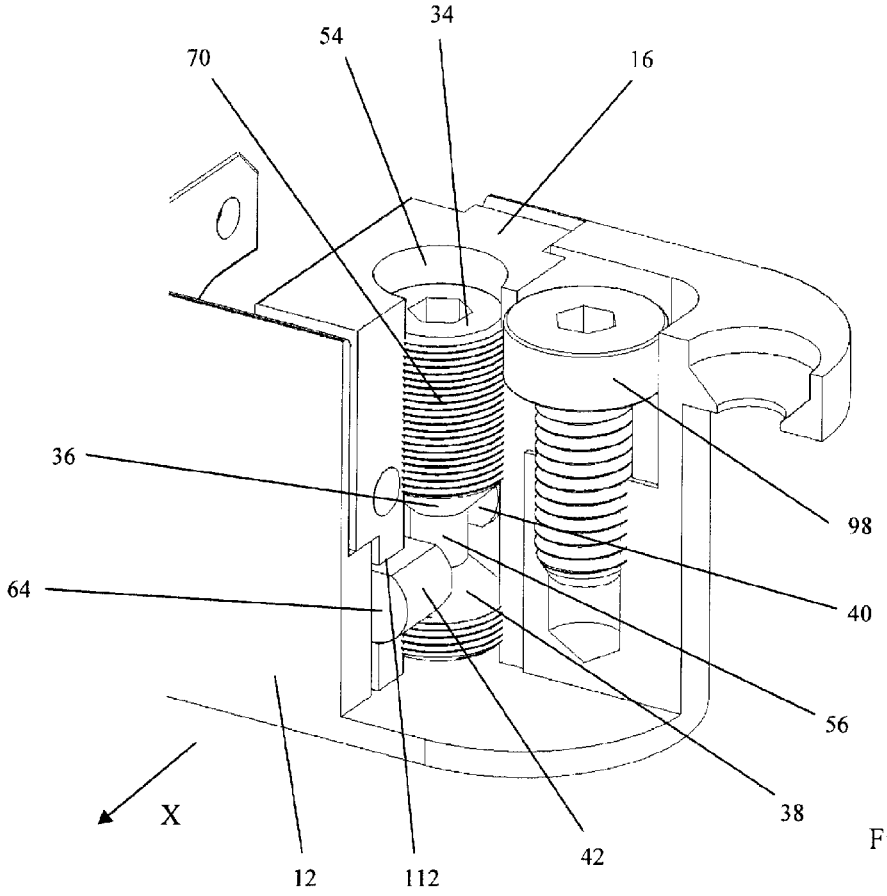
FIG. 5 is a further partial sectional view of a detail of a hardware system according to the invention.
Figure 6:
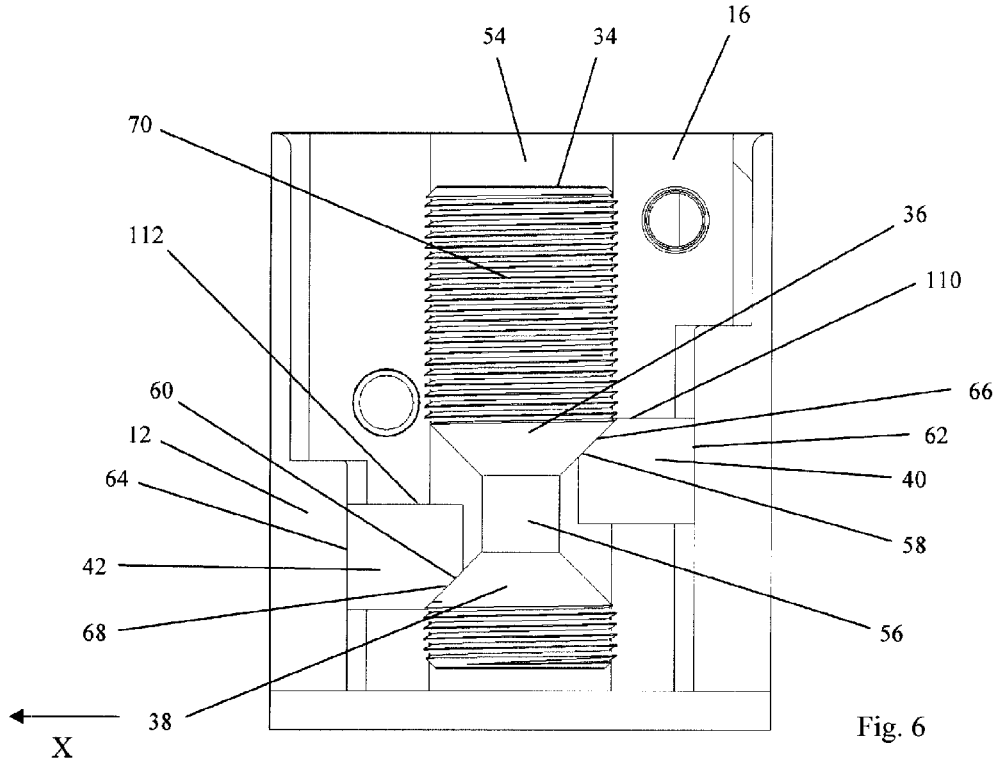
FIG. 6 is a further partial sectional view of a detail of a hardware system according to the invention.

The adjustment of the hardware system 10 in the x-direction is described with particular reference to FIGS. 5 and 6. The mechanism shown in these figures is located in the first housing 12 and the associated hardware body 16. An adjustment pin 34 comprising a recess 56 is screwed into a hole 54 in the first hardware body 16. The recess 56 is delimited by conical surfaces 36, 38. Sliding pins 40, 42 are provided so as to correspond to the conical surfaces 36, 38 and can come into contact with the conical surfaces 36, 38. In the process, the sliding ends 58, 60 of the sliding pins 40, 42 can interact with the conical surfaces 36, 38 of the adjustment pin 34 by means of contact lines 66, 68. The ends of the sliding pins 40, 42 opposite the sliding ends 58, 60 of the sliding pins 40, 42 each form a stop 62, 64 on the housing 12. Openings 110, 112 through which the respective sliding pins 40, 42 protrude are provided in the hardware body 16. If the adjustment pin 34 is thus displaced in the y-direction in the hardware body 16 by means of the thread 70, constraining forces are produced by the sliding pins 40, 42, and these forces act on the adjustment pin 34 and thus on the hardware body 16 and are finally absorbed by the housing 12. When the adjustment pin 34 is displaced upwards, i.e. in the positive y-direction, the hardware body 16 is thus made to move in the negative x-direction (to the right in FIG. 6). When the adjustment pin 34 is displaced further into the hardware body 16, relative displacement of the hardware body 16 and the housing 12 is produced in the opposite direction.

Figure 7:
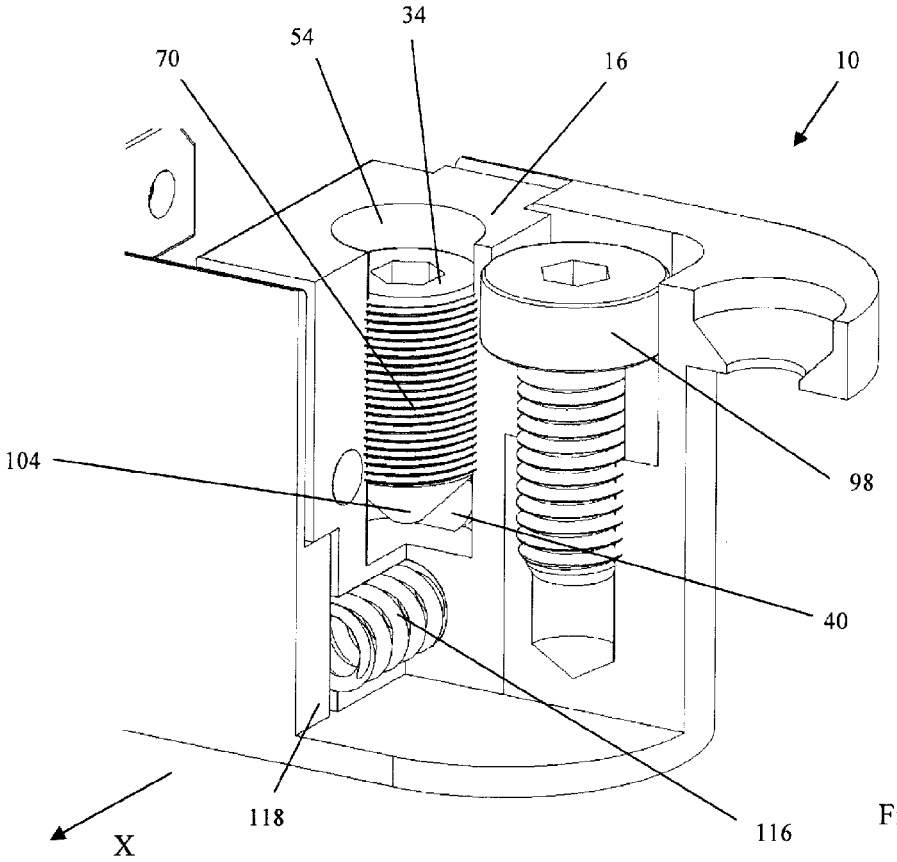
FIG. 7 is a further partial sectional view of a detail of a hardware system according to the invention according to another embodiment.
Figure 8:
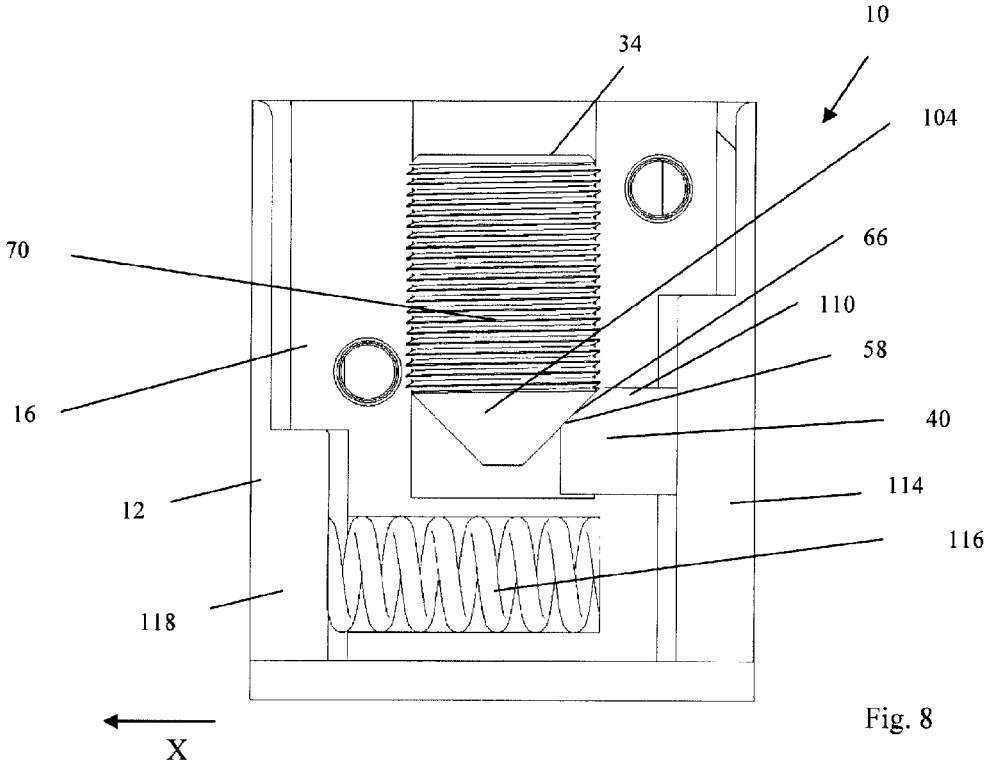
FIG. 8 is a further partial sectional view of a detail of a hardware system according to the invention according to the additional embodiment.

The adjustment of another embodiment of a hardware system 10 according to the invention is described with particular reference to FIGS. 7 and 8. Unlike in the embodiments according to FIGS. 5 and 6, provision is made here of just one sliding pin 40, which limits the relative movement between the hardware body 16 and the housing 12. Accordingly, the adjustment pin 34 is equipped with a conical end 104, which interacts with the sliding pin 40. In the process, the sliding pin 40 is supported at its end facing away from the adjustment pin 34 by means of a stop 62 on a first housing side 114. In this respect, the function is similar to the embodiment described in connection with FIGS. 5 and 6. However, in the present embodiment, a spring 116 is also provided, one end of which is supported on a second housing side 118 opposite the first housing side 114. The other end of the spring 116 is supported on the hardware body 16. If the adjustment pin 34 is rotated out of the hardware body 16, the tension in the spring 116 can be increasingly released and the hardware body 16 thus moved relative to the housing 12. If the adjustment pin 34 is rotated into the hardware body 16, the hardware body 16 is displaced together with the adjustment pin 34 in a direction which compresses the spring 116.

Figure 9:
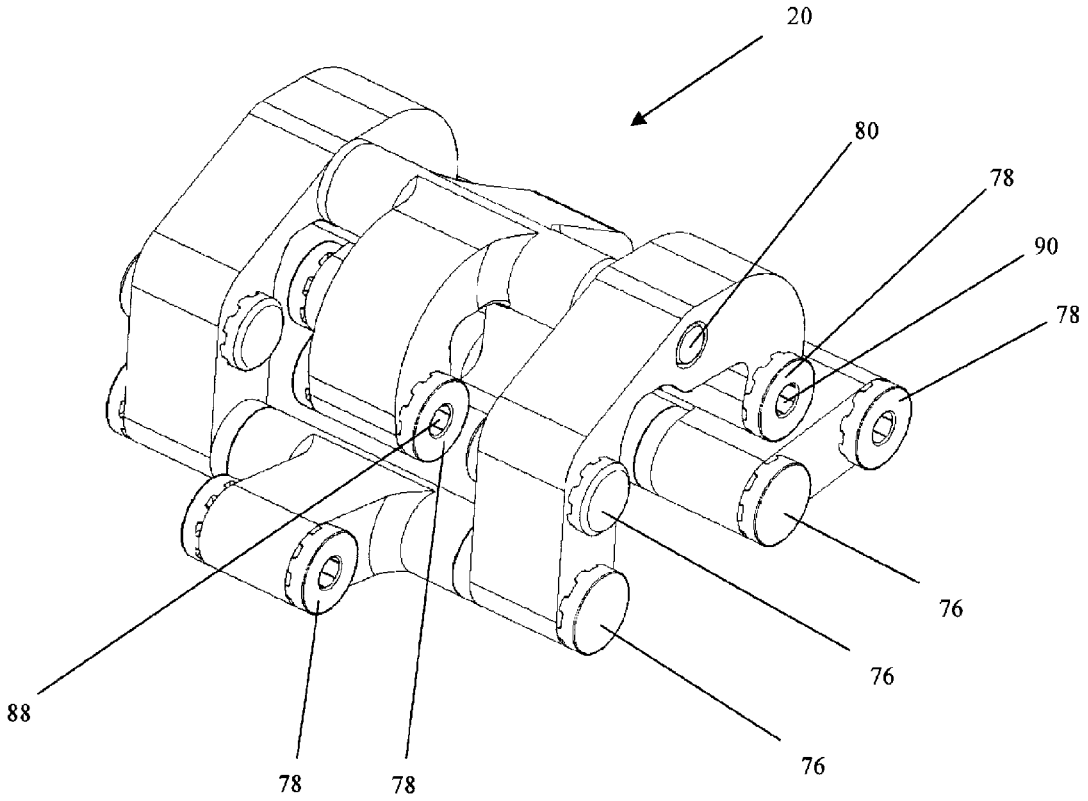
FIG. 9 is a perspective view of a lever system for a hardware system according to the invention.

FIG. 9 is a perspective view of a lever system 20 for a hardware system according to the invention. In this figure, the lever system 20 is shown in particular to illustrate sliding faces 76 and sliding rotation points 78. While the sliding rotation points 78 are always rigidly connected to the respective hardware bodies by means of hinge pins, this is not the case for the sliding faces 76, which are guided by side faces of the hardware bodies. Two hinge pins 88, 90, which are also shown in FIG. 1, are marked specifically, since these are essential for fixing one side of the levers to the hardware body. The hinge pin 80 which interconnects the individual levers is also marked.

Figure 10:
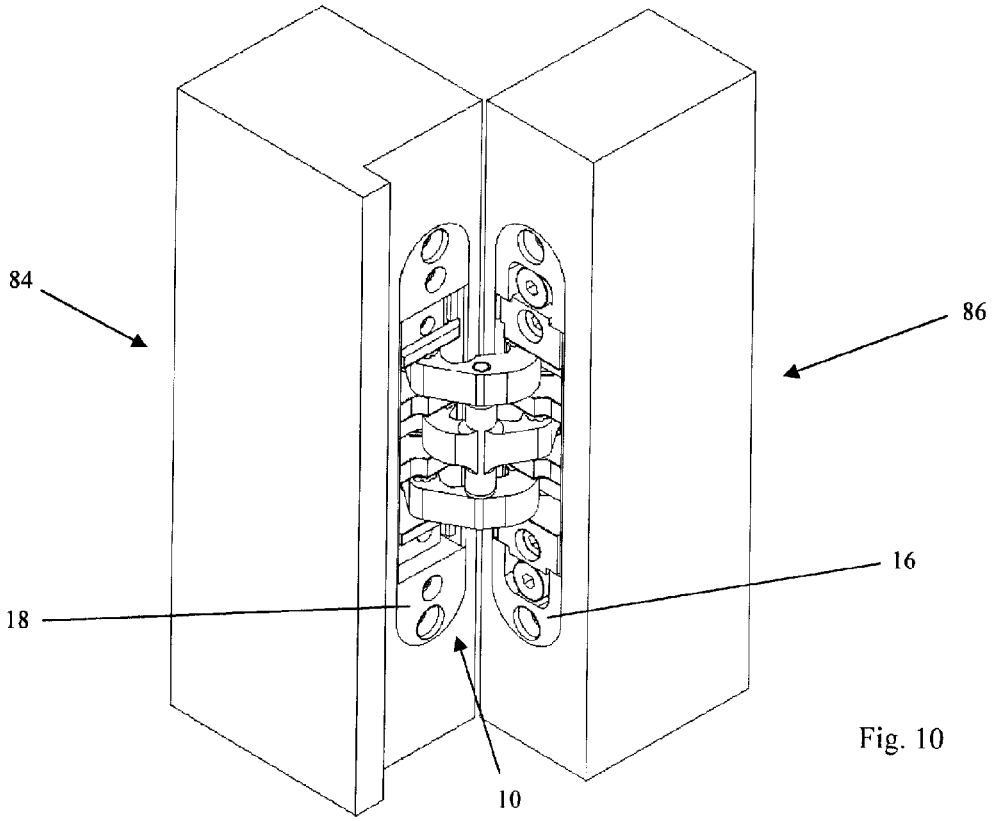
FIG. 10 shows a hardware system according to the invention during use.

FIG. 10 shows a hardware system according to the invention during use. This may be, for example, a door frame 84 and a door 86. The hardware body 16 arranged in the door 86 is the body which provides for adjustment in the x-direction, while the hardware body 18 arranged in the door frame 84 ensures that adjustment in the y and z-directions is possible.

LIST OF REFERENCE NUMERALS

10 hardware system
12 housing
14 housing
16 hardware body
18 hardware body
20 lever system
22 lever
24 lever
26 lever
28 guide pin
30 threaded pins
32 threaded pins
34 adjustment pin
36 conical surface
38 conical surface
40 sliding pins
42 sliding pins
44 sliding guide
46 end of the hardware body
48 end of the hardware body
50 oblique face of the guide profile
52 conical end of the threaded pin
54 hole
56 recess
58 sliding end
60 sliding end
62 stop
64 stop
66 contact line
68 contact line
70 thread
72 threaded screw
74 threaded element
76 sliding faces
78 sliding rotation points
80 hinge pin
82 sliding guide
84 door frame or window frame
86 door or window
88 hinge pin
90 hinge pin
92 sliding guide
94 sliding guide
96 hinge pin
98 fastening screw
100 fastening screw
102 threaded screw
104 conical end
106 adjustment pin
108 housing opening
110 opening
112 opening
114 first housing side
116 spring
119 second housing side

The invention claimed is:

1. A three-dimensionally adjustable hardware system (10) comprising a first housing (12) and a second housing (14), a first hardware body (16) which is arranged in the first housing (12) at least in part, a second hardware body (18) which is arranged in the second housing (14) at least in part, and a lever system (20) interconnects the first hardware body (16) and the second hardware body (18), an extension of at least one lever (22, 24, 26) of the lever system (20) defining an xy-plane between the first hardware body (16) and the second hardware body (18) and defining a z-axis perpendicularly to the xy-plane, and, in order to adjust the hardware system in the y-direction, at least one of the housings (14) and the at least one hardware body (18) arranged therein comprise at least one sliding guide (44) which extends along a y-axis and along which the hardware body (18) is displaceable relative to the respective housing (14) in the y-direction, in order to adjust the hardware system (10) in a z-direction, at least one of the hardware bodies (18) comprises at least one guide pin (28) and the housing (14) in which the at least one hardware body (18) is arranged comprises at least one threaded pin (30, 32), the at least one guide pin (28) and thus the hardware body (18) being displaced relative to the housing (14) in the z-direction by rotating the threaded pin (30), in order to adjust the hardware system (10) in an x-direction, at least one of the hardware bodies (16) receives at least one adjustment pin (34) which is displaceable along the y-axis located in the xy-plane, and at least one surface (36, 38) of the adjustment pin (34), which has a face that is oblique with respect to the y-axis, interacts with at least one sliding pin (40, 42), a movement of which along the x-axis, located in the xy-plane, is limited by the housing (12) which receives the at least one hardware body (16), such that the hardware body (16) is displaceable relative to the housing (12) in the x-direction by displacing the adjustment pin (34).

2. The three-dimensionally adjustable hardware system (10) according to claim 1, wherein in order to adjust the hardware system (10) in the z-direction, the at least one hardware body (18) comprises two of the guide pins (28) which are arranged on opposite ends (46, 48) of the hardware body (18) in the z-direction, the guide pins (28) comprise oblique faces (50) that are oblique with respect to the z-axis, one of the threaded pins (30, 32) is associated with each of the guide pins (28), and ends of the threaded pins (30, 32) interact in each case with the oblique faces (50) of the guide pins (28).

3. The three-dimensionally adjustable hardware system according to claim 2, wherein at least one of the threaded pins (30) has a conical end (52) which interacts with the oblique face (50) of the associated guide pin (28).

4. The three-dimensionally adjustable hardware system according to claim 2, wherein the oblique faces (50) of the guide pins (28) are formed as flat faces or conical surfaces.

5. The three-dimensionally adjustable hardware system according to claim 2, wherein at least one of the threaded pins (30, 32) extends perpendicularly to the z-axis.

6. The three-dimensionally adjustable hardware system according to claim 2, wherein at least one of the threaded pins extends in parallel with the z-axis.

7. The three-dimensionally adjustable hardware system (10) according to claim 1, wherein in order to adjust the hardware system (10) in the x-direction, the adjustment pin (34) extending in the y-direction engages in a hole (54) in one of the hardware bodies (16) and is provided with a recess (56) which comprises conical faces (36, 38) at opposite ends thereof in the y-direction, said faces each interact with sliding ends (58, 60) of two of the sliding pins (40, 42), opposite ends of the sliding pins (40, 42) forming a stop (62, 64) with an associated one of the housings (12) and being slidingly connected to the one of the hardware bodies (16) such that the one of the hardware bodies (16) is displaceable relative to the associated one of the housings (12) by displacing the adjustment pin (34) in the x-direction.

8. The three-dimensionally adjustable hardware system according to claim 7, wherein both the hole (54) in the hardware body (16) and the adjustment pin (34) are provided with a corresponding thread (70).

9. The three-dimensionally adjustable hardware system (10) according to claim 1, wherein in order to adjust the hardware system (10) in the x-direction, the adjustment pin (34) extending in the y-direction engages in a hole (54) in the one of the hardware bodies (16) and comprises a conical end (104) which interacts with a sliding end (58) of one of the sliding pins (40), an opposite end of the sliding pin (40) forming a stop (62) with a first housing side (114) and being slidingly connected to the one of the hardware bodies (16), and a spring (116) being supported on a second housing side (118), which is opposite the first housing side (114), and on the one of the hardware bodies (16).

10. The three-dimensionally adjustable hardware system according to claim 9, wherein contacts between the adjustment pin (34) and the sliding pin (40, 42) are formed by contact lines.

11. The three-dimensionally adjustable hardware system (10) according to claim 1, wherein in order to adjust the hardware system (10) in the y-direction, at least one threaded screw (72) is provided, which is mounted in one of the hardware bodies (18) and is guided by a threaded element (74), the movement of which in the y-direction is limited by the associated housing (14).

12. The three-dimensionally adjustable hardware system according to claim 11, wherein the threaded element (74) carries the guide pin (28) provided for adjusting the hardware system (10) in the z-direction.

13. The three-dimensionally adjustable hardware system according to claim 1, wherein the lever system (20) comprises sliding faces (76) which interact with sliding guides (82) of the hardware bodies (16, 18), sliding rotation points (78) which are fixed to the hardware body, and a hinge pin (80) which is movable along the xy-plane, at least one of the sliding faces, (76) the sliding guides (82), the sliding rotation points (78), or components of the hinge pin (80) being equipped with plastics material.

14. The three-dimensionally adjustable hardware system (10) according to claim 1, wherein a plurality of the levers (22, 24, 26) of the lever system (20) are attached in each case to one of the hardware bodies (16, 18) by a hinge pin (88, 90) and in each case interact with the other of the hardware bodies (18, 16) by a sliding guide (82).

* * * * *